US005782055A

United States Patent [19]

Crittenden

[11] Patent Number: 5,782,055

[45] Date of Patent: Jul. 21, 1998

[54] DOOR APPARATUS AND METHOD OF MAKING DOOR

[76] Inventor: Jerry G. Crittenden, 3939 W. Clarendon Ave., Phoenix, Ariz. 85019

[21] Appl. No.: 755,406

[22] Filed: Nov. 22, 1996

[51] Int. Cl.[6] ..... E06B 3/72; E04C 2/54

[52] U.S. Cl. ..... 52/784.1; 52/455; 52/783.12; 52/316; 52/779; D25/48

[58] Field of Search ..... 52/314, 316, 455, 52/779, 783.11, 783.12, 783.15, 783.17, 784.1, 630; D25/47, 48

[56] References Cited

U.S. PATENT DOCUMENTS

| | | | |
|---|---|---|---|
| 1,241,685 | 10/1917 | Van Dorn | 52/783.15 X |
| 1,895,553 | 1/1933 | Nordell | 52/783.12 |
| 3,305,992 | 2/1967 | Steed | 52/455 X |
| 4,236,365 | 12/1980 | Wheeler | 52/784.1 X |
| 4,265,067 | 5/1981 | Palmer | 52/455 X |
| 4,812,188 | 3/1989 | Hansen | 52/455 X |
| 4,837,999 | 6/1989 | Stayner | 52/783.11 X |
| 4,860,512 | 8/1989 | Thorn | 52/455 X |
| 5,016,414 | 5/1991 | Wang | 52/455 X |
| 5,074,087 | 12/1991 | Green | 52/455 X |
| 5,074,092 | 12/1991 | Norlander | 52/455 |
| 5,095,675 | 3/1992 | Audia | 52/455 |
| 5,219,634 | 6/1993 | Aufderhaar | 52/455 X |
| 5,293,726 | 3/1994 | Schick | 52/801.12 X |
| 5,438,800 | 8/1995 | Costello | 52/316 |
| 5,540,026 | 7/1996 | Gartland | 52/455 |

*Primary Examiner*—Christopher Kent
*Assistant Examiner*—Yvonne Hozton Richardson
*Attorney, Agent, or Firm*—H Gordon Shields

[57] ABSTRACT

Door apparatus includes a perimeter frame and material inwardly from the perimeter frame has been removed from both sides of the door asymmetrically to allow the inner portion of the door to warp in response to temperature and/or humidity conditions without affecting the planar nature of the door perimeter frame. The perimeter frame remains in its original, planar, configuration so as to remain true regardless of the warping of the interior portion of the door due to temperature and/or humidity. The method of making the door includes the asymmetrical removal of the material from the inner portion of the door inwardly from the perimeter door frame on both sides of the door to provide relatively thin webs between relatively thick door portions.

18 Claims, 4 Drawing Sheets

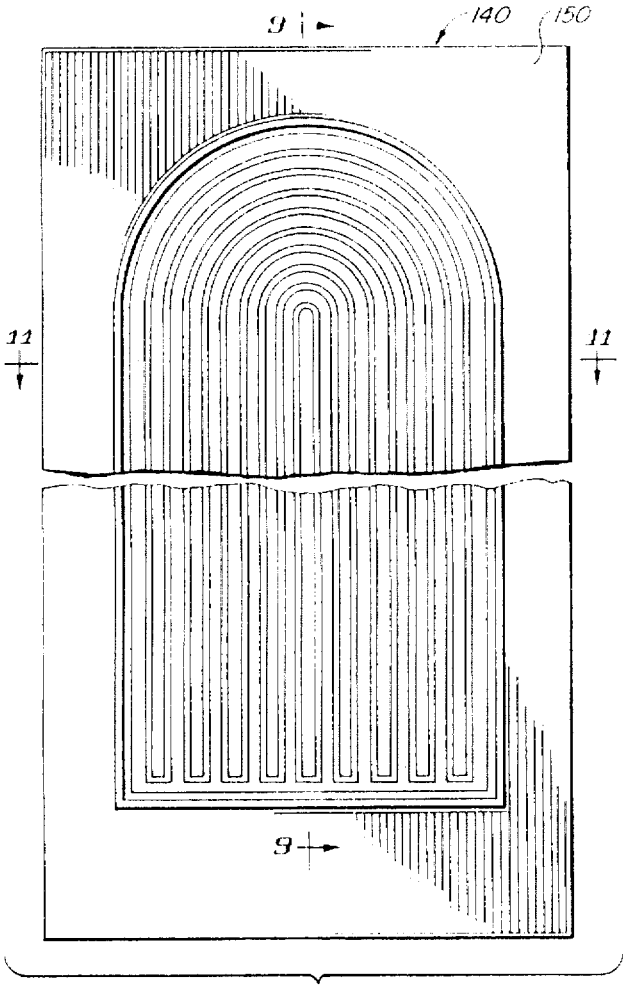
FIG. 8
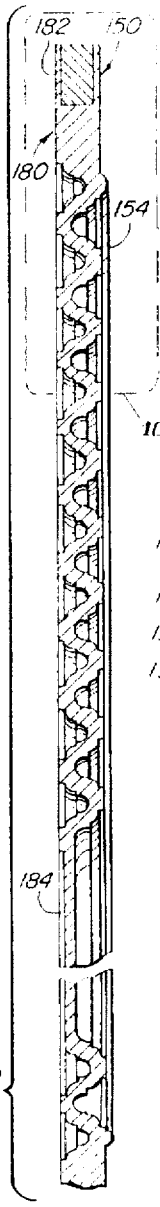
FIG. 9
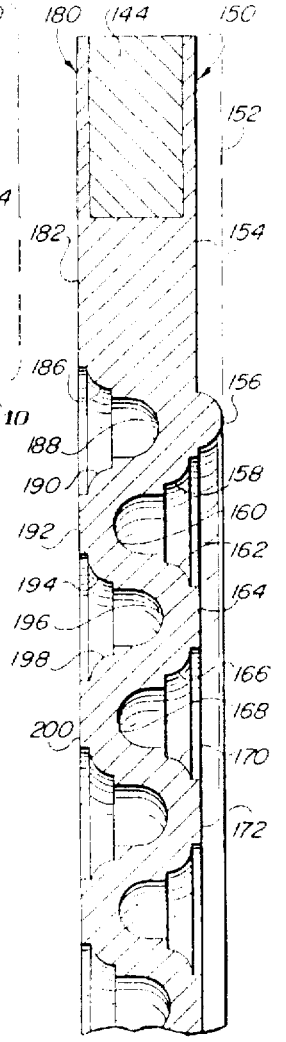
FIG. 10
FIG. 11
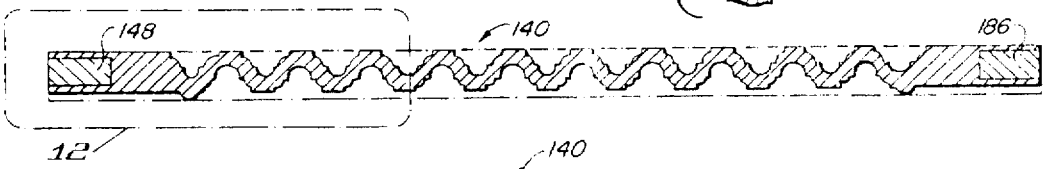
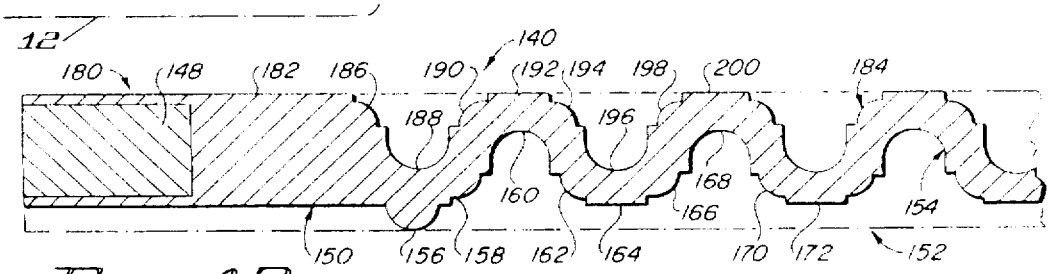
FIG. 12

DOOR APPARATUS AND METHOD OF MAKING DOOR

BACKGROUND OF THE INVENTION

1. Field of the Invention

This invention relates to doors and, more particularly, to flush doors having a perimeter frame and a center portion within the perimeter frame in which the center portion of the doors warp in response to temperature and/or humidity conditions but the door perimeter frame remains in its unwarped condition so as to fit snugly against the door frame and jamb regardless of the temperature and/or humidity conditions.

2. Description of the Prior Art

There are generally two types of exterior doors, one is called a panel door, and the other is called a flush door. Panel doors include side stiles, a top rail, a bottom rail, and an intermediate lock rail, all of which are secured together. Extending generally parallel to and between the stiles, and secured between the rails, are vertical mullions. Panels float between the stiles, rails, and mullions. That is, the panels are not securely fastened to the perimeter frame, which includes the stiles, the bottom and top rails, and the lock rail and the mullions. The reason for allowing the panels to float is to minimize the warping or twisting of the door.

Wood expands generally across the grain or width, and there is very little expansion, if any, along the length of the wood. Accordingly, the stile and rail parts of a door are fastened together to define a rigid frame, and the panels then float within the frame. Thus, when the panels expanded and contracted in response to temperature and/or humidity, they did so without affecting the perimeter frame.

The flush door is built with concealed stiles and rails and is covered with a plywood or hardboard skin, with a honeycomb or a solid core of wood blocks or particle board, foam, etc., within the skins and the stiles and rails. A problem with this type of flush door is the warping of the door in response to temperature and/or humidity conditions. Since there is now no floating elements, which are allowed to expand and contract, the entire door warps and twists as it expands and contracts in response to the temperature and/or humidity.

The apparatus of the present invention overcomes the prior art problems by having a relatively solid door, in that there are no floating panels, and yet the perimeter frame remains generally true, while the center of the door, the material inwardly from the perimeter frame, expands and contracts in response to temperature and/or humidity. However, the expansion is generally perpendicular to the perimeter frame of the door, and thus allows the perimeter frame to remain true.

Prior art theory with respect to warping, namely the expanding and contracting, of doors simply provided that doors should have the same surface area on the front and the back. The idea behind this was that any warpage that would occur would essentially offset each other. That is, the same amount of warpage would occur on both sides of the door and the warpage would essentially cancel each other out, thus allowing the door to remain in its planar configuration. If decorative panels are asymmetrically disposed on opposite sides of the door, warpage tends to cause the door to bow, with the crown on the side of the door with the most surface area. However, as indicated above, even the equal surface area theory, while it may have in fact minimized warpage, does not eliminate the expansion and contraction, and thus the warping of the door.

Wooden doors, particularly exterior doors, expand and contract and generally warp in response to temperature and/or humidity conditions. Heretofore, when a door, particularly a relatively large door, warps in response to temperature and/or humidity, the entire door warps, thus preventing a tight fit against a door frame and jamb, thereby causing problems with air leakage. This can be of particular nuisance in hot climates where air conditioning is a problem in summer and in areas where heating is a problem in winter. Another problem is that warping may interfere with the door latching properly or adequately with the strike plate. This results in a security problem.

In the prior art, generally both sides of a door were machined symmetrically, and accordingly humidity and temperature warping resulted in warping the entire door, including the perimeter frame. The door apparatus made by the method of the present invention includes asymmetrically removing or machining material from both sides of the door to allow the various door panels or portions to expand and contract without affecting the perimeter frame.

The apparatus of the present invention overcomes the problem of door warping by allowing the center portion of the door, the portion inwardly from the outer door perimeter, to warp, thus allowing the perimeter frame to remain in its original planar integrity so as to maintain its alignment relative to the outer door frame and jamb.

Web areas in the center portion allow expansion and contraction generally perpendicular to the perimeter frame while allowing the perimeter frame to remain generally true.

SUMMARY OF THE INVENTION

The invention described and claimed herein comprises a door and a method of making a door in which the perimeter door frame remains in alignment while the interior of the door, or the portion of the door inward from the perimeter of the frame, warps in response to temperature and/or humidity. The warping of the interior portion of the door is accomplished by removing material, in decorative patterns, from both the inside and outside of the door. The relieved portions are complimentary in that webs remain after the material is removed, and the webs allow the inner portions of the door to warp without causing a warping of the perimeter frame.

Among the objects of the present invention are the following:

- To provide new and useful door apparatus;
- To provide new and useful door apparatus having an outer perimeter frame and a center portion which warps in response to temperature and/or humidity and allows the outer perimeter frame to remain generally true;
- To provide new and useful door apparatus having a perimeter frame and material removed from both sides of the door inwardly of the perimeter frame;
- To provide a new and useful door having a perimeter frame and a front skin and a back skin bonded to the perimeter frame;
- To provide a new and useful method of making a door;
- To provide a new and useful method of making a door having a perimeter frame and wooden material inwardly from the perimeter frame;
- To provide a new and useful method of making a door by removing material asymmetrically from the inside and the outside of the door; and
- To provide a new and useful method of making a door by bonding a front and a back skin to a perimeter frame.

BRIEF DESCRIPTION OF THE DRAWING

FIG. 8 is a front plan view of an alternate embodiment of the door apparatus of the present invention.

FIG. 9 is a view in partial section taken generally along line 9—9 of FIG. 8.

FIG. 10 is an enlarged view in partial section taken generally from oval 10 of FIG. 9.

FIG. 11 is a view in partial section taken generally along line 11—11 of FIG. 8.

FIG. 12 is an enlarged view in partial section taken generally from oval 12 of FIG. 11.

DESCRIPTION OF THE PREFERRED EMBODIMENT

Figure 1:
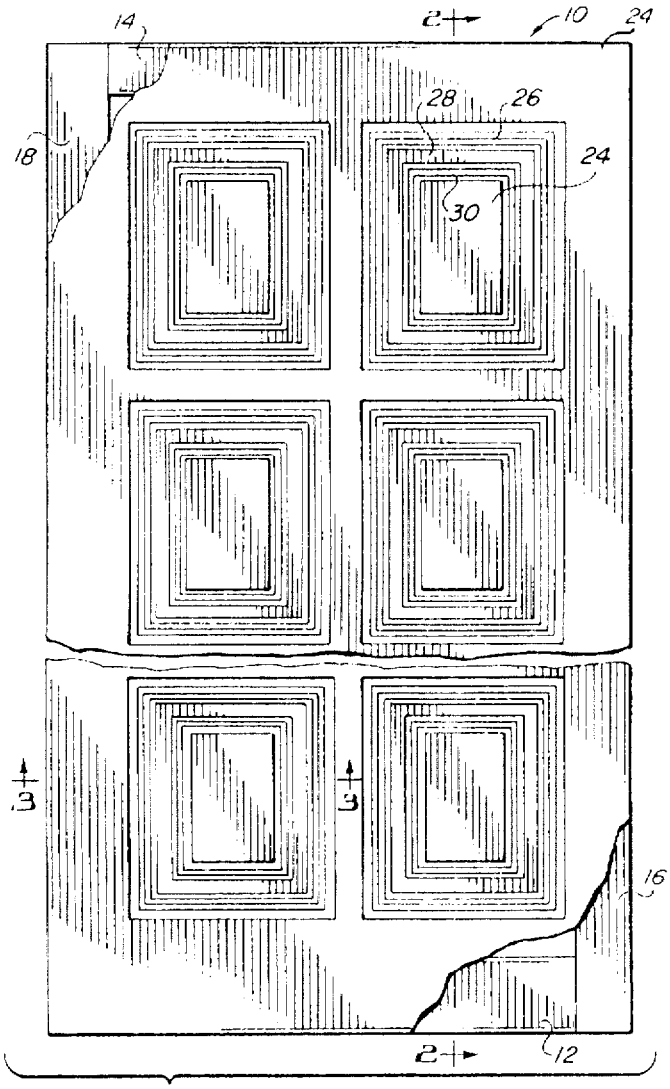
FIG. 1 is a front plan view, partially broken away, of a door apparatus of the present invention.

FIG. 1 is a plan view of a door 10 embodying the present invention. The door 10 includes an outer peripheral frame including a bottom rail 12, a top rail 14, and a pair of vertically extending side stiles 16 and 18. The rails 12 and 14 extend horizontally and are parallel to each other, and the stiles 16 and 18 are also generally parallel to each other. The stiles 16 and 18 extend the full height of the door 10, while the rails 12 and 14 butt against the stiles.

Figure 2:
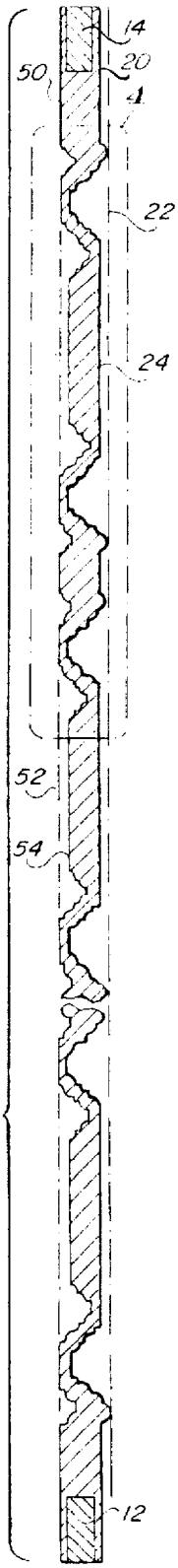
FIG. 2 is a view in partial section taken generally along line 2—2 of FIG. 1.
Figure 3:
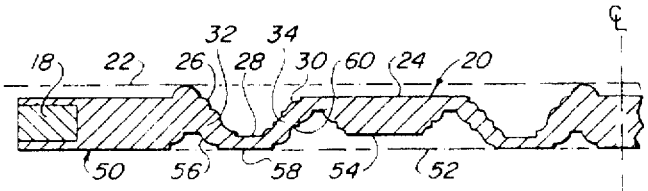
FIG. 3 is a view in partial section taken generally along line 3—3 of FIG. 1.
Figure 4:
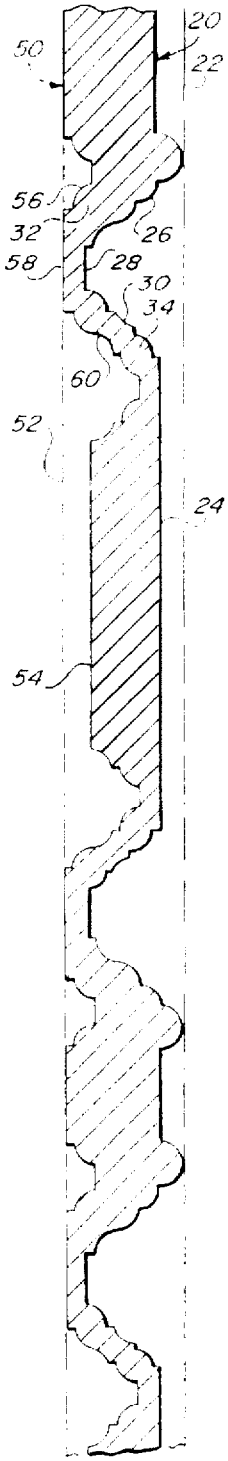
FIG. 4 is an enlarged view in partial section taken generally from oval 4 of FIG. 2.

FIG. 2 is a view in partial section taken generally along line 2—2 of FIG. 1. FIG. 3 is a view in partial section taken generally along line 3—3 of FIG. 1. FIG. 4 is an enlarge view of a portion of a door 10 taken generally from oval 4 of FIG. 2. The door 10 includes a front side 20 and a rear side 50. The rear side 50 is indicated in FIGS. 2, 3, 4, and 5, while the front side 20 is shown in FIGS. 1, 2, 3, and 4.

Figure 5:
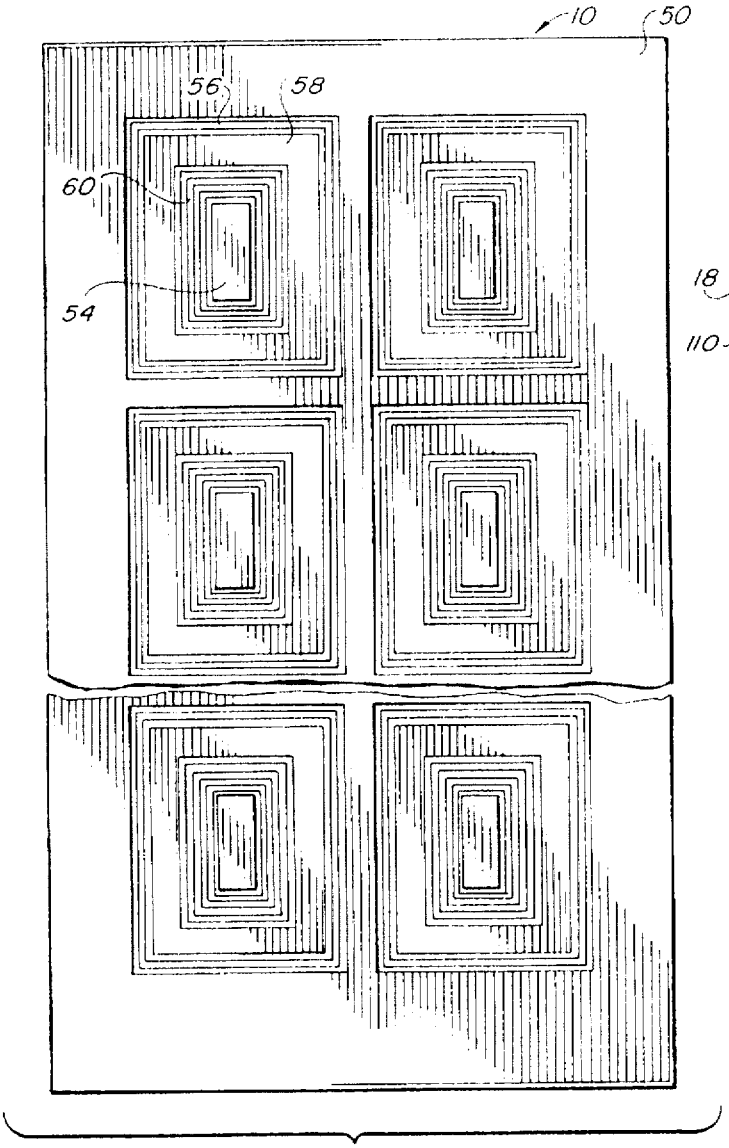
FIG. 5 is a rear plan view of the door of FIG. 1.

FIG. 5 is a plan view of the rear side 50 of the door 10. For the following discussion, reference will be made to FIGS. 1, 2, 3, 4, and 5.

The perimeter frame of the door apparatus 10 includes the four rail and stile elements 12, 14, and 16, 18. As best shown in FIGS. 2, 3, and 4, both the front side 20 and the back side 50 of the door 10 have had material removed therefrom. Reference numeral 22 denotes the original face of the front side 20, and reference numeral 52 indicates the original face of the back side 50. Reference numerals 22 and 52 delineate dash dot lines which are generally parallel to each other. The final configuration of the front side of the door 20 is indicated by reference numeral 24, and the final configuration or face of the rear side of the door 10 is indicated by reference numeral 54.

Material has been removed from both the front side 20 and the back side 50 of the door 10. As shown in FIGS. 3 and 4, on the front side 20 there is a horizontally curved portion 26, and a horizontally curved portion 30 with a horizontal flat portion 28 between the two curved portions 26 and 30.

On the back side 50, there is a curved portion 56 and a curved portion 60 disposed on opposite sides of a flat portion 58. The flat portions 28 and 58 are aligned with each other, as are the curved portions 26 and 56 and the curved portions 30 and 60. A web 32 is defined between the curved portions 26 and 56 and a web 34 is defined between the curved portions 30 and 60.

The pattern of curved portions and flat portions between the curved portions for both the front side and the back side, with the curved portions defining intervening or connecting webs between the flat portions, is repeated in the horizontal design configuration of the door 10.

Similarly, a pattern of curved portions with flat portions between them on both the front side 20 and the back side 50 is repeated for the vertical design, as indicated in FIG. 3. In FIG. 3, a flat portion 28 is disposed between a pair of curved portions 26 and 30 on the front side 20, and a flat portion 58 is disposed between a pair of curved portions 56 and 60 on the back side 50. The curved portions result in webs 32 and 34 adjacent to the flat portions 28 and 58.

The curved portions and flat portions on both the front side 20 and the back side 50 are repeated to provide the desired aesthetic effect that may be seen in FIGS. 1 and 5.

The asymmetrical design of the flat portions and curved portions, with the attendant webs, comprise asymmetrical design configurations on the door apparatus 10 and allow the various door portions to expand and contract, and thus to deform or warp, at the web areas. The expansion and contraction, or warping, is generally perpendicular to a plane through the outer perimeter frame of the stiles and rails of the door. Thus, the stiles and rails, and accordingly the perimeter frame, remain generally plumb or true, while the portion of the door inwardly from the outer perimeter frame warps or expands and contracts at the web areas in response to the temperature and/or humidity conditions.

Figure 6:
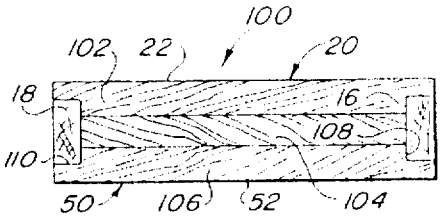
FIG. 6 is an end view of a door blank.
Figure 7:
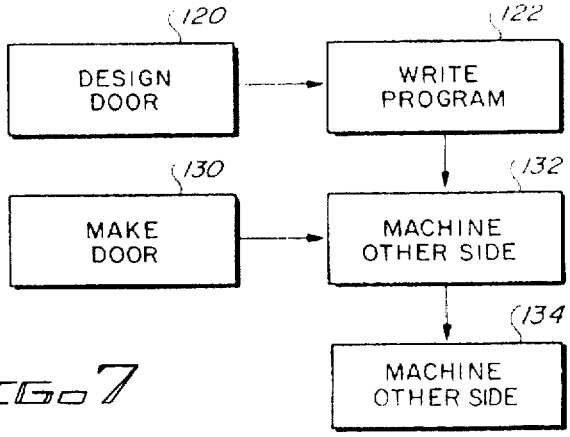
FIG. 7 is a block diagram illustrating the method used in making the door apparatus of the present invention.

The structure of a door blank is illustrated in FIG. 6, and the method of making a finished door from a door blank is illustrated in block diagram form in FIG. 7. FIG. 6 comprises a schematic view in partial section through a door blank 100, showing generally the sides stile 16 and 18 spaced apart from each other and generally parallel to each other. The door blank 100 includes three sheets 102, 104, and 106 appropriately bonded together. After bonding, the three sheets of the now bonded door blank are machined on both ends and the sides to provide rabbets for the stiles. Rabbets 108 and 110 are shown in which the side stiles 16 and 18 are respectively inserted and appropriately secured therein.

The door blank 100 is thus a unitary element made of three solid sheets 102, 104, and 106 appropriately bonded together, with top, bottom, and side areas rabbeted to receive the side stiles and the top and bottom rails. The original faces 22 and 52 of the front and back sides 20 and 50, respectively, are thus the outer faces of the top and bottom sheets 102 and 106, respectively. The stiles and rails and their adjacent structure comprise the perimeter door frame.

If desired, a single sheet blank may also be used. The single sheet blank would be appropriately rabbetted to receive the stiles and rails.

While a door blank is being made, as indicated in block 130, a design is being developed, as indicated in block 120. That is, the final configuration of the door, with its various curved portions, flat portions, etc., on both sides of the door, is being designed. Such design, of course, includes the webs which allow for the expansion and contraction, and thus the warping, of the door inwardly from the stiles which warping allows the perimeter frame of the door to remain true.

After a door is designed, a program is written to control a CNC (Computer Numerical Control) milling machine.

This is indicated in block 122. After the program has been written, the program is fed into the memory of the CNC milling machine. The door blank, such as the blank 100 of FIG. 6, is then placed on the bed of a milling machine, and one side of the door is milled according to the design specification under the control of the computer program previously written. This is indicated in block 132.

When the one side of the door has been machined, the door blank is then turned over and the second side of the door is then machined, also in response to the computer program. This is indicated in block 134.

As may be understood from FIGS. 2, 3, and 4, material is removed from both sides of the door blank 100, but the material is moved asymmetrically such that the material remaining includes a plurality of relatively thin webs which allow the material inwardly from the perimeter frame to warp, by expanding and contracting, in response to temperature and/or humidity conditions. The expanding and contracting of the inner portion of the door blank is, of course, perpendicular to the plane of the outer perimeter of the door, allowing the outer perimeter of the door to remain generally square or true. This, of course, allows the door to fit well within its door frame, against the door jamb, etc.

In describing the configuration of the door above, the terms "curved portion" and "flat portion" have been used. It will be understood that the "curved portion" actually comprises a plurality of different types of curves, or configurations, as opposed to flat portions, as may be understood from FIGS. 2, 3, and 4, and also as may be understood from FIGS. 1 and 5. The curved portions are actually a series of grooves of various depths and of various configurations. A series of grooves and their adjacent "high spots," etc., determine the final configuration of the door.

A second type of configuration of a door is illustrated in FIGS. 8, 9, 10, 11, and 12. FIG. 8 is a plan view of a front of a door 140, and FIG. 9 is a view in partial section taken generally along line 9—9 of FIG. 8. FIG. 10 is an enlarged view in partial section taken generally from oval 10 of FIG. 9 illustrating a particular portion of the door 140. FIG. 11 is a view in partial section taken generally along line 11—11 of FIG. 8, and FIG. 12 is an enlarge view in partial section taken generally from oval 12 of FIG. 11.

FIGS. 9 and 10 are taken generally vertically, and FIGS. 11 and 12 are taken generally horizontally. FIGS. 9, 10, 11, and 12 accordingly illustrate the design configuration of the door 140 and show the configuration of the design relative to expansion and contraction. For the following discussion, reference will be made to FIGS. 8, 9, 10, 11, and 12.

Rather than the generally rectangular pattern for the door 10 illustrated in FIGS. 1–5, a different type configuration is illustrated in FIGS. 8, 9, 10, 11, and 12, for a door 140.

Three perimeter frame elements are shown for the door 140, including a top rail 144, and a pair of side stiles 146 and 148. The three perimeter frame elements, together with the bottom rail, (not shown) and the adjacent material, comprise the outer perimeter frame for the door 140.

The door 140 also includes a front side 150 and a back or rear side 180. For the front side 150, reference numeral 152 indicates the original face, while the final face is denoted by reference numeral 154. For the back side 180, the original face is indicated by reference numeral 182, and the final face by reference numeral 184. It will be noted that substantially more material is removed from the front face 150 than from the back or back side 180. That is, the final face 184 is closer to the original face 182 than the final face 154 is to the original face 152.

As may be seen from FIG. 9, the configuration of the design for the door 140 comprises a plurality of straight, rectangular, and curved elements. For the front face 150, there is an outer high ridge or rounded land 156, and inwardly from the ridge 156 is a curved transition side wall 158. The side wall 158 extends to a bottom groove 160. Outwardly from the bottom groove 160 is another side wall curve transition 162. The side wall transitions 158 and 162 are essentially mirror images of each other. The side wall transition 162 extends to a flat ridge or land 164. From the ridge or land 164 another side wall transition 166 extends to a groove 168, and from the groove 168 another side wall transition 170 extends to a flat ridge or land 172. The ridges or lands 164 and 172 are substantially identical to each other, and the side wall transitions 166 and 170 are substantially identical to each other and are mirror images of each other, and they are also substantially identical to the side wall transitions 158 and 162. The pattern of ridges, transitions and grooves continues throughout the pattern.

For the back side or rear side 180, there is a similar pattern of a side transition 186 which extends to a bottom groove 188. From the groove 188, a side wall transition 190 extends to a flat land or ridge 192. From the land or ridge 192, a similar side wall transition 194 extend to another groove 196, and then a side wall transition 198 extend to another land or ridge 200. Again, the side wall transitions 186 and 190 are substantially mirror images of each other, and are substantially identical to the side wall transitions 194 and 198, which are also mirror images of each other. Moreover, the grooves 188, 160, 196, 168, etc., are alternating and are substantially identical to each other, as are the side wall transitions 158, 190, 162, 194, etc. In other words, the configurations on both sides of the door 140 are essentially identical to each other and alternating to provide a relatively serpentine pattern extending laterally between the (right and left) sides of the door. The serpentine pattern comprises essentially a continuous web which allows for the desired expansion and contraction, and thus warping, in a direction generally perpendicular to the outer perimeter frame.

The pattern illustrated in FIG. 10 is also repeated in FIG. 12. That is, FIGS. 9 and 11, with their enlarged portions shown in FIGS. 10 and 12, are generally identical to each other and simply comprise continuations of the same groove and land pattern shown in FIGS. 9 and 10, which comprise vertical pattern, and as illustrated in FIGS. 11 and 12 for the horizontal pattern.

The asymmetrical removal of the material from the front and back sides of the blank of the door 140 results in the serpentine pattern illustrated in FIGS. 9–12. The serpentine configuration comprises a continuous web which may expand and contract in response to temperature and/or humidity conditions by moving generally perpendicular to the outer perimeter frame, thus allowing the outer perimeter frame to remain straight and hue.

As may be understood from the two patterns illustrated for the doors 10 and 140, there are many patterns which allow for the asymmetrical removal of material from both sides of a door that result in web areas which may expand and contract inwardly from the outer perimeter of the door and the expansion and contraction of those areas allows the outer perimeter of the door frame to remain generally straight and true, thus matingly engaging its door frame.

Figure 13:
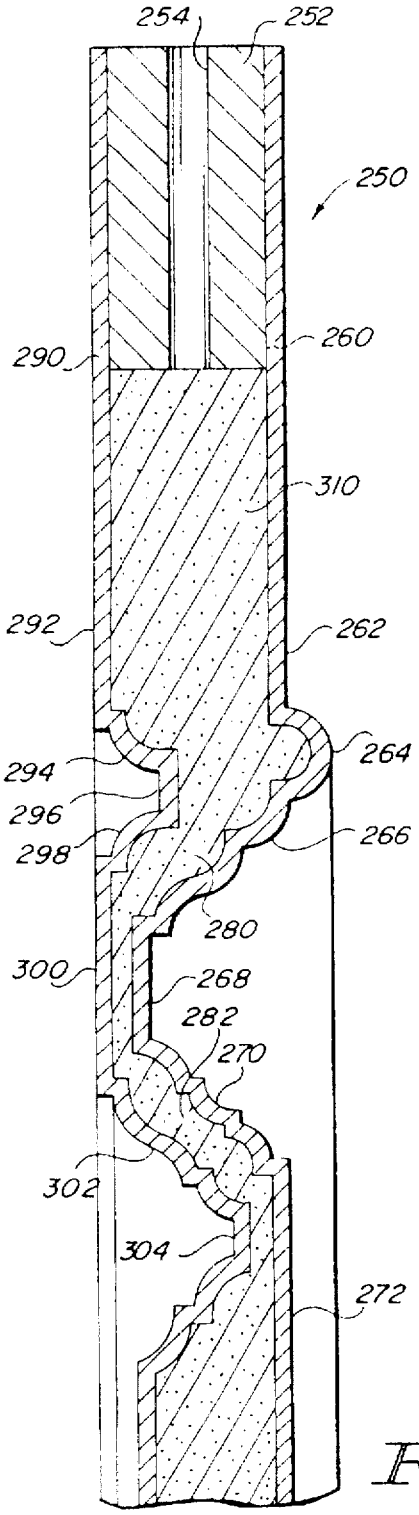
FIG. 13 is an enlarged fragmentary view in partial section of an alternate embodiment of the apparatus of the present invention.

FIG. 13 is a fragmentary view in partial section of an alternate embodiment door 250. The door 250 still includes the stiles and rails which define a perimeter frame, but the door 250 includes molded outer, or front and back, skins and foam material or the like in injected into the door between the front and back skins. The configuration of the molded skins conforms to the concept set forth above, with a series of webs extending between and connecting flat portions, or serpentine lands and grooves, which allows the webs to warp in response to temperature and/or humidity, while the perimeter frame remains generally true. The configuration of the front and back skins is asymmetrical, as set forth above for the previous embodiments.

It will be noted that the configuration of the door 250 is the same as the configuration of the door 10. This may be ascertained by comparing FIG. 13 to FIGS. 2, 3, and 4.

The door 250, as shown in FIG. 13, includes a top rail 252 and an outer (front) skin 260 and an inner (back) skin 290.

On the outer or front side of the door 250, the outer skin 260 includes a raised ridge 264 which extends outwardly from a flat 262 adjacent to the rail 252. A curved transition 266 extends from the ridge 264 to an inner flat 268. From the inner flat 268 there is a curved transition 270 which extends to an outer flat 272.

The flats 268 and 300 are generally opposite or aligned with each other, and the curved transitions 266, 298 and 270, 302 define webs 280 and 282, respectively, which extend on opposite sides of the flats 268, 300.

The design configuration for the inner or back skin 290 includes a curved transition 294 which extends from a flat 292 adjacent to the rail 252 to an inner or lower flat 296. Another curved transition 298 extends to an outer flat 300. From the outer flat 300 there is another curved transition 302 which extends to another inner flat 304.

Extending through the top rail 252 is a bore 254. Appropriate foam material 310, such as polyurethane foam, is inserted into the door 250 through the bore 254 and fills the space between the rails and stiles and the skins 260 and 290. Again, the asymmetrical configuration of the skins, with the webs, flats, etc., allows the skins and the foam material to warp generally perpendicular to the plane of the door in response to temperature and/or humidity conditions. The warping takes place primarily at the web areas.

Figure 14:
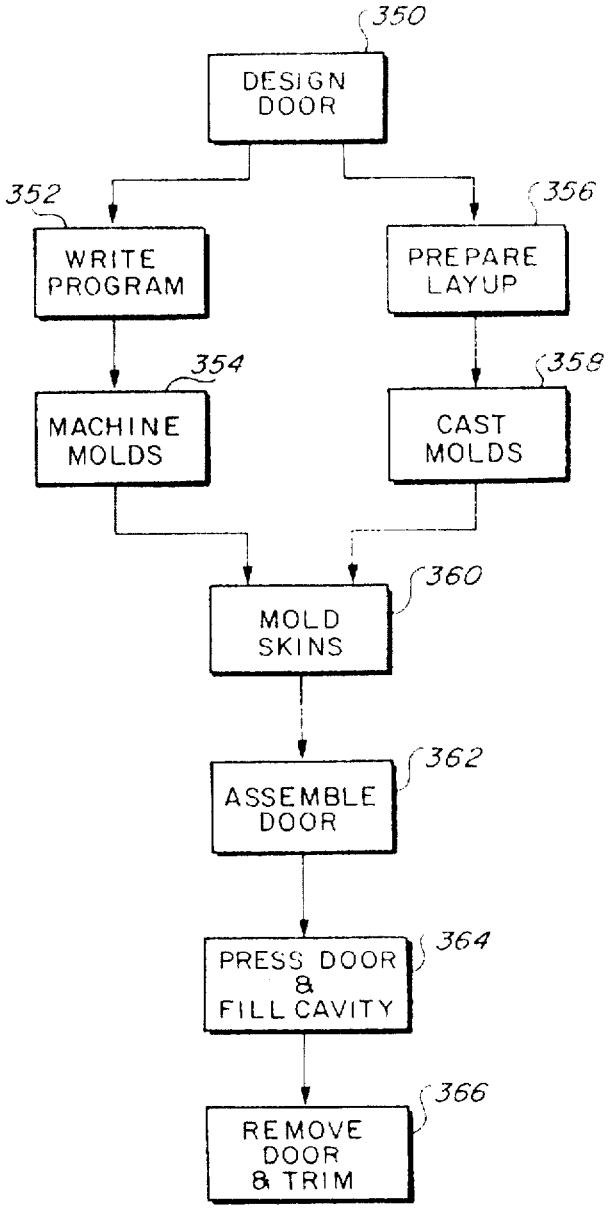
FIG. 14 is a block diagram illustrating the method of making the door apparatus of FIG. 13.

FIG. 14 is a block diagram illustrating the manufacturing process for the door 250.

The configuration of a door is first designed, as indicated by block 350. For casting the skins, there are alternate methods, as indicated by the generally parallel blocks 352, 254 and 356, 358. If the skins are to be machined, then a program is written for the four molds required for the two skins. This is indicated by block 352. There are four molds required, since the top and bottom, or front and rear, skins are different from each other and each requires two molds.

After the program is written for machining the molds by a CNC milling machine, the molds are machined, as indicated by block 354.

There is another way to prepare molds, and that is by way of casting. First, there is the step of laying up the molds, as indicated in block 356. Then, as indicated by block 358, the molds are cast. Again, four different molds are needed for the two skins.

Next, the skins are molded, as indicated by block 360. That is, both a top (front) skin is molded and a bottom (rear) skin is molded.

A top and a bottom (front and rear) skin are then assembled to a pair of side stiles and to a top and a bottom rail. This assembly step is indicated by block 362.

When the stiles and rails and skins have been assembled, the assembled elements are placed in a press to bond the elements together. At the press, the foam material is inserted into the hollow space or cavity between the skins and pressure and heat are used to bond the elements together to complete the door. This is indicated in block 364.

After the bonding by heat and pressure. The door is removed from the press and is appropriately trimmed. This is the final step in making the door 250, and is shown in block 366.

The door skins may be made of appropriate composite material, such as medium density fiberboard, fiberglass, a fiber reinforced plastic material, a resin bonded fiber reinforced ceramic material, or even a metal, such as steel, or other appropriate material. Regardless of the material out of which the door skins are molded, the asymmetrical design of the door skins allows warpage in response to temperature and/or humidity while the perimeter frame remains generally true.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Door apparatus comprising in combination:

a door, including a front side, a back side, and a perimeter frame;

a grooved first pattern on the front side;

a grooved second pattern on the back side asymmetrical with the first pattern to define a plurality of webs between the front and back sides, whereby the webs allow the door to expand and contract generally perpendicular to the perimeter frame in response to temperature and/or humidity and the perimeter frame remains generally true.

2. The apparatus of claim 1 in which the first and second patterns include pluralities of grooves and ridges on both the front side and the back side.

3. The apparatus of claim 1 in which the first and second patterns comprise curved portions and flats on both the front side and the back side.

4. A method of making a door comprising the steps of:

providing a door blank, having a front side, a back side, and a perimeter frame; and removing material from the front side and the back side of the door blank asymmetrically to define a plurality of webs, whereby the webs expand and contract in response to temperature and/or humidity and the perimeter frame remains generally true.

5. The method of claim 4 which further includes the step of designing a pattern for the removal of material from the front and back sides.

6. The method of claim 5 which further includes the steps of providing a CNC milling machine for removing the material from the door blank and programming the CNC milling machine according to the designed pattern.

7. The method of claim 4 in which the step of providing a door blank includes the steps of:

laminating a plurality of sheets of designed material;

rabbeting the outer edges of the laminated sheets; and installing stiles and rails in the rabbets to define the perimeter frame.

8. The method of claim 7 in which the step of laminating a plurality of sheets includes the step of providing three sheets of medium density fiberboard to be laminated together.

9. Door apparatus comprising in combination:

a perimeter frame; and a center portion having a front side and a back side within the perimeter frame, including web means including a plurality of asymmetrically disposed lands and grooves which expand and contract in response to temperature and/or humidity without affecting the perimeter frame.

10. The apparatus of claim 9 in which the center portion includes a plurality of flat portions and the web means includes a plurality of curved portions asymmetrically disposed between the flat portions, and which asymmetrically disposed curved portions define a plurality of webs which expand and contract.

11. The apparatus of claim 9 in which the center portion includes a front skin and a back skin secured to the perimeter frame.

12. The apparatus of claim 11 which further includes a foam material disposed within the perimeter frame between the front and back skins.

13. A method of making a door comprising the steps of:

providing a perimeter frame;

providing a center portion secured to the perimeter frame, and having a front side and a back side;

providing asymmetrical surfaces on the front and back sides of the center portion including a plurality of webs which expand and contract in response to temperature and/or humidity and allow the perimeter frame to remain generally true.

14. The method of claim 13 in which the step of providing asymmetrical surfaces includes the step of milling the top and bottom sides in response to a predetermined design.

15. The method of claim 13 which the step of providing asymmetrical surfaces includes the steps of providing a front skin and a back skin and bonding the front and back skins to the perimeter frame.

16. The method of claim 15 in which the step of providing asymmetrical surfaces further includes the step of molding the front and back skins.

17. The method of claim 16 in which the step of molding the front and back skins includes the step of molding asymmetrical patterns in the front and back skins to provide the plurality of webs.

18. The method of claim 17 which includes the further step of injecting foam through the perimeter frame and between the front and back skins.

* * * * *